United States Patent [19]

Stalhut

[11] 4,397,208

[45] Aug. 9, 1983

[54] JEWELRY TAG MARKING METHOD

[76] Inventor: B. R. Stalhut, P.O. Box 2326, Stateline, Nev. 89449

[21] Appl. No.: 85,634

[22] Filed: Oct. 17, 1979

[51] Int. Cl.[3] ..... B26D 3/08

[52] U.S. Cl. ..... 83/880; 33/18 B; 33/23 F; 83/451; 83/565; 269/289 R

[58] Field of Search ..... 83/879, 880, 451, 565; 101/32; 33/18 B, 23 F; 51/216 R; 269/289 R, 302, 303, 309, 40; 409/903

[56] References Cited

U.S. PATENT DOCUMENTS

| | | | |
|---|---|---|---|
| 663,741 | 12/1900 | Ewen | 51/216 R |
| 919,689 | 4/1909 | Brand | 33/23 F |
| 1,038,486 | 9/1912 | Brand | 23/23 F |
| 1,343,553 | 6/1920 | Faichney | 269/289 R |
| 1,911,221 | 5/1933 | Blair | 51/216 R |
| 2,152,801 | 4/1939 | Harrington | 269/309 X |
| 2,346,719 | 4/1944 | Aske | 83/69 |
| 3,043,175 | 7/1962 | Gallob | 83/879 |
| 3,392,256 | 7/1968 | Bradham | 269/305 X |
| 3,453,783 | 7/1969 | Queen | 51/216 LP |
| 4,056,136 | 11/1977 | Miller | 269/289 R |

OTHER PUBLICATIONS

*Technical Digest No. 42*, Western Electric Corp., Apr. 1, 1976, pp. 19 & 20, M. J. Hoffman et al.

*Primary Examiner*—James M. Meister
*Attorney, Agent, or Firm*—Herbert C. Schulze

[57] ABSTRACT

This invention is a method and apparatus for marking tags for use on jewelry to indicate the characteristics of the jewelry and prices and the like wherein the possibility of alteration is minimized by the use of tags having a coating which is penetrated by a stylus or the like, and wherein such tags are held in place within a specially designed holding templet for ease of holding. The principal characteristics of the invention involve the method of holding the tags (which themselves are known) while being marked with a stylus and the apparatus itself which holds the tags comprising an appropriate material with templates fitting the tags.

2 Claims, 11 Drawing Figures

JEWELRY TAG MARKING METHOD

BACKGROUND OF THE INVENTION

1. Field of the Invention

This invention is in the general field of tags for items of jewelry such as rings, necklaces and the like, and is more particularly directed to such tags wherein the markings are made by penetration of a coating on the tag material itself by use of a stylus or the like, and is even more particularly related to and directed to the method and apparatus for holding such tags in order to speed the marking time, improve the accuracy of marking, eliminate wastage, and eliminate fatigue or the persons performing the marking operations.

The invention is even more particularly directed to an apparatus which provides a smooth gliding surface for the hand of the person doing the marking and wherein the tags are held in place within recessed areas in said surface so located as to be convenient.

2. Description of the Prior Art

I have been unable to locate any prior art directed to the invention which comprises the apparatus for holding jewelry tags wherein the method consists of placing the tags within appropriately designed openings within a proper surface upon which the hand of the person making the markings may rest. Further, I have found no device for practicing this method, which device comprises an appropriate surface with properly positioned and defined openings therein to hold jewelry tags during the marking process. The tags themselves are, of course, well known and it is only the method and apparatus for holding them and marking which are involved in this invention.

SUMMARY OF THE INVENTION

In the jewelry field there are many valuable items of jewelry which must be marked with tags giving information concerning the characteristics of the jewelry such as the size of stones, the fineness of the metal, and other features peculiar to each individual piece. Additionally, the price and frequently other information is desired.

It is known to those skilled in the art that persons will frequently attempt to alter or exchange markings upon valuable jewelry to indicate lower values and thus to practice a form of thievery.

Over the years, for the purposes of eliminating the type of thievery which can be practiced with bogus tags, various means for identifying the jewelry have been adopted. One of the most commonly used of the special type of tags for jewelry includes a tag material of paper, plastic, or the like, coated with a metallic paint or the like, wherein the markings are made by breaking through the coating with a stylus or other appropriate instrument. Such markings are very difficult to alter, and the tags themselves become difficult to change since many of them employ special clip devices which cannot be removed, once affixed, without destruction of the tag. Other tags using the same type of coating sometimes have special strings or the like, which can be tied to certain types of jewelry and again cannot effectively be removed and exchanged without breaking of the string.

The jewelry tags are very small and it is quite a difficult task to hold the tags during the marking process.

A person employed in marking jewelry tags is subjected to great fatigue in holding the tag while marking and thus there is normally a limited amount of time in which a person can continuously mark tags. Additionally, due to the small size of the tags, it is frequently difficult to mark appropriately because the fingers of the hand holding the tag are literally "in the way" of the stylus and cause the operator discomfort and will result in waste of many tags, as well as rather poor rates of production of the markings of such tags.

I have studied this problem and I am sure other persons have studied the problem because of the difficulty of holding such tags.

Clips and the like under which the tags may be slipped for holding are impractical and can create false markings due to the fact that the marking is obtained by breaking through the coating and any clips sufficient to hold properly will usually scratch the surfaces. Additionally, the clips will obstruct part of the surface and make the marking operation difficult and will obscure certain areas of the tag upon which markings may be desired.

I have now conceived, developed and exhaustively tested a unique method and apparatus for accomplishing the desired end. I have accomplished this by utilizing a thin sheet of metal or the like, into which have been cut openings in the exact shape of the individual tags to be marked. This sheet of material is then mounted upon a base material so that the tag is held with the surface being marked approximately flush with the top of the metallic surface in which the opening has been formed.

With a tag in the opening with the metallic or other sheet upon the base as described, an operator can very effectively mark the tag with a stylus in one hand and without the necessity of the other hand being in contact with the tag during the marking operation. Results of tests over a fairly long period of time show that a person marking jewelry tags can usually mark approximately twice as many tags in any given period of time as the same person will do if marking the tags without the use of this method and apparatus as described. Additionally, it is found that fatigue is not a problem and the person marking such tags can mark continuously over a much greater period of time than when it is necessary to hold the tag in the customary manner.

Having developed the fundamental method and apparatus, I have further gone on to an extension of the invention by including means to spring load a number of tags into one opening so that a tag may be marked, removed, and another tag appear without the necessity of individual loading within the opening. Likewise, I have extended the invention to include a production line type arrangement wherein the tag holding apparatus may be carried in a continuous manner upon an appropriate moving belt or the like; And, further, I have even extended the invention so that a pantograph like arrangement can be used so that one operator can mark several tags at one time when desired.

It is an object of this invention to provide a method and apparatus for holding jewelry tags within the surface of a material in such manner that the tags may be marked without being held by a human hand or any other device covering the surface of the tag.

Another object of this invention is to provide such a method and apparatus wherein an operator may mark tags with greater efficiency than in the past.

Another object of this invention is to provide such a method and apparatus as described wherein one operator can mark a multiplicity of tags at one time.

The foregoing and other objects and advantages of this invention will become apparent to those skilled in the art upon reading the description of a preferred embodiment which follows, in conjunction with a review of the appended drawings.

DESCRIPTION OF A PREFERRED EMBODIMENT

Figure 1:
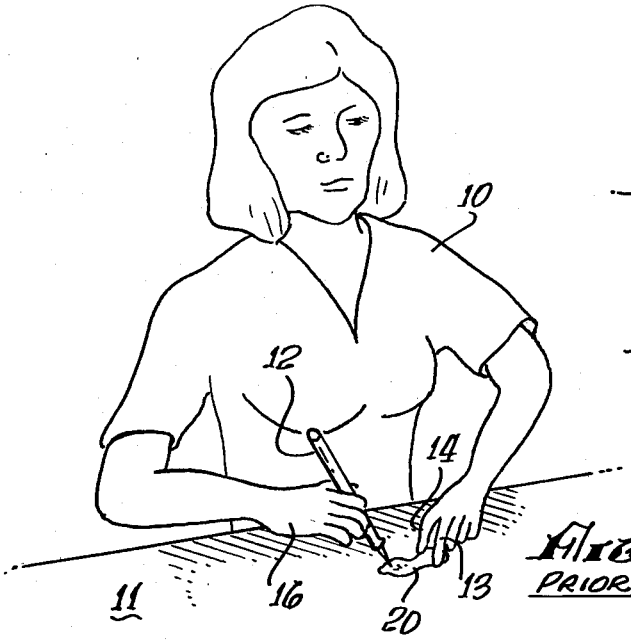
FIG. 1. PRIOR ART
FIG. 1 is a schematic perspective of an operator marking jewelry tags according to the custom prior to the present invention.
Figure 2:
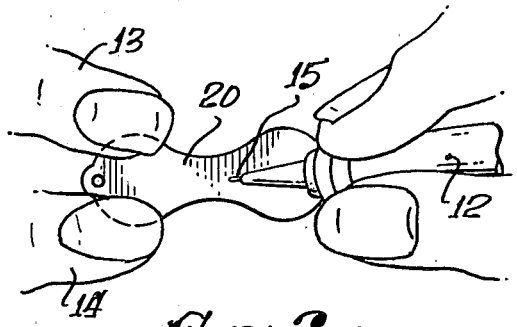
FIG. 2. PRIOR ART
FIG. 2 is an enlarged schematic perspective, partially broken away, showing the fingers and stylus utilized in the method of FIG. 1 in larger detail.

The prior art in the marking of jewelry tags of the nature described, which tags are tags having a coating on each side which is broken by stylus to provide the marks, is illustrated in FIGS. 1 and 2. In the prior art, a tag 20 is held by the fingers 13 and 14 of one hand of the operator 10. Normally the tag would be held upon a table or other suitable work surface 11 and the stylus 12 would be utilized in the hand 16 of the operator 10.

It will be observed that the fingers 13 and 14 must cover at least a portion of the tag 20 and it will also be obvious that with a small tag of this nature it is difficult to hold it in place for proper marking.

Figure 3:
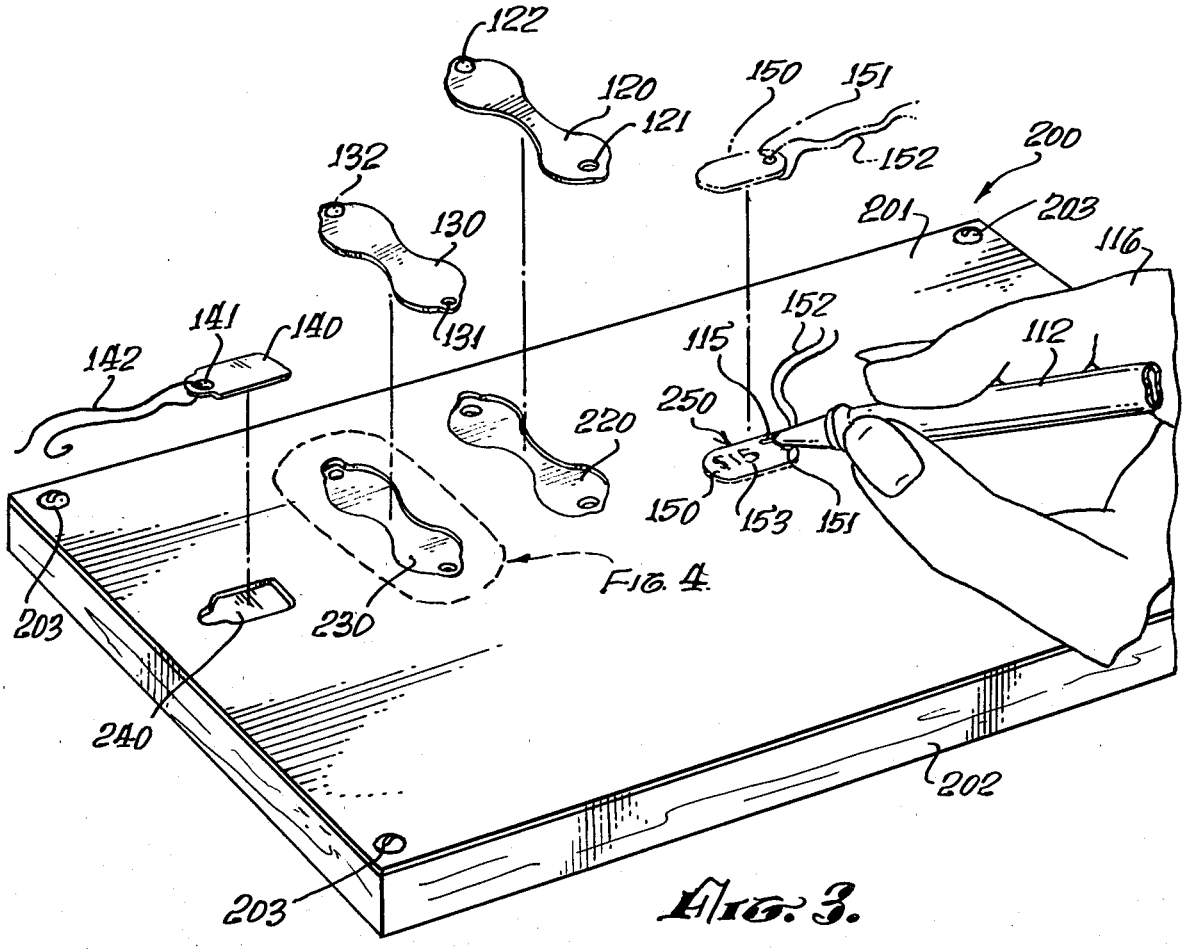
FIG. 3 is a partially broken away perspective of a preferred embodiment of an apparatus to practice the method of this invention.

FIG. 3 illustrates the presently most preferred embodiment of an apparatus to practice the method of this invention. There is a base material 202 which can be wood or the like, covered with a thin sheet material 201 which will preferably be stainless steel, although other materials can be used as will be hereinafter described. The sheet material 201 will be fastened to the base either by an adhesive material (not shown but which will be understood by those skilled in the art) or by screws or the like 203 as shown in the illustration in FIG. 3. This combination comprises the entire apparatus generally 200.

It will be observed that a number of different shaped openings 220, 230, 240, and 250 have been provided within the sheet 201, but not within the base material 202. Each of these openings is of a particilar shape to fit one of the various shapes of jewelry tags. For example, the shapes 220 and 230 are ideally adapted to accommodate tags 120 and 130 which are customary ring tags. The openings 240 and 250 will accommodate tags 140 and 150 which are different shapes, usually used for necklaces and the like. It is to be understood that there are many other shapes of these special jewerly tags and the mere illustration of some of the shapes is not at all restrictive. Having once learned the method and apparatus of this invention, it will be possible to expand it to the size of any tag. The ones illustrated are purely for illustration and certainly not for limitation.

Figure 7:
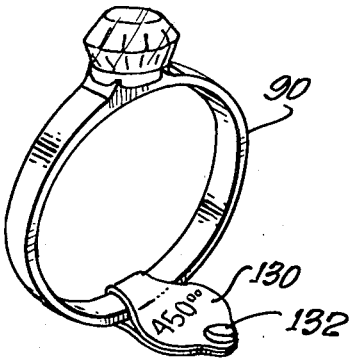
FIG. 7 illustrates a tag of the nature being marked in FIG. 4 in place upon a ring.

Further studying FIG. 3 it will be observed that tag 120 and 130 each have an opening 121 and 131 respectively to receive the locking tab 122 and 132 respectively. The exact functioning of the tab within the hole in each case is illustrated in FIG. 7 which will now be described for ease of understanding. In FIG. 7 there is shown a customary ring 90 wherein a tag 130 has been fastened around it and the tab 132 has been forced through the hole 131 so that the tag 130 is now firmly attached to the ring.

Returning to FIG. 3, it will be seen that a tag 150 having a hole 151 with a string 152 is in place within the opening 250 in the cover sheet 201. The hand 116 of an operator is shown to be holding stylus 112 having its marking point 115 being utilized to make the marks 153 appearing on the surface of the tag 150. Immediately above the tag 150 the tag is shown in phantom indicating that it had previously been removed from the opening 250 and of course, it will once again be removed upon completion of the marking.

Likewise, the tags 120 and 130 will be capable of being placed within their openings for marking. Also, of course, a different shaped tag 140 attached through hole 141 to a string 142 can be utilized within the opening 240.

Normally each device 200 will have a series of openings to accommodate each different size and shape of tag. Thus an operator can use one such apparatus for any size tag. However, if desired, such an apparatus 200 could be provided to accommodate only one size and shape of tag if desired.

Previously reference was made to the use of stainless steel for the material 201.

This is another discovery I have made. Customarily, the working surface upon which an operator will be working is a wooden desk or the like. In developing this device, I experimented with and have tested the results of many different materials. While it is possible to utilize many materials for the cover sheet 201, and while it is also possible to even have a solid material rather than utilizing the base material and the cover material, wherein the solid material merely has an opening milled to a definite depth in it, stainless steel seems to provide unusually desireable results. The covering of stainless steel is thin and therefore neither excessively heavy nor expensive. Yet, it seems to have a feel and durability such that an operator is comfortable; And, the operator's hand becomes less fatigued when gliding over the stainless steel as compared to other surfaces tried. It is not believed that this invention should be limited to a stainless steel sheet, but it is pointed out that this is the most desireable material and it is felt that this in itself is a sub-invention.

Figure 4:
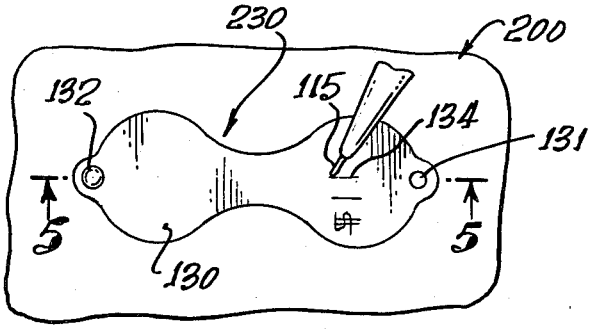
FIG. 4 is an enlarged plan view of the area enclosed in the dotted line in FIG. 3 with the addition of a jewelry tag and the front portion of a stylus shown making markings thereon.

FIG. 4 is inserted primarily to give a larger plan view of a tag of the configuration of tag 130 being marked within the opening 230 in the device 200. Each of the elements has previously been shown, but in this case, the tag has now been placed in position within the opening 230 and the stylus point 115 is making marks such as 134 upon the tag for future use.

Figure 5:
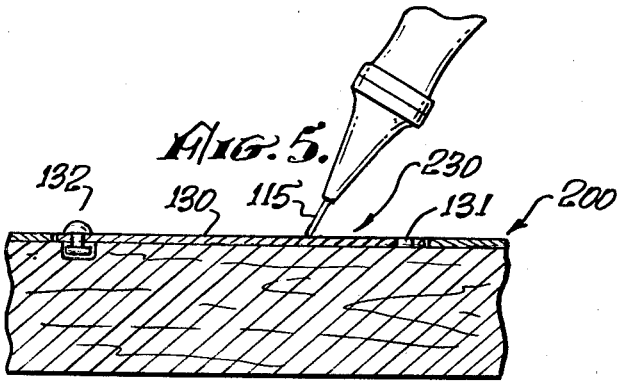
FIG. 5 is a section on 5—5 of FIG. 4.

FIG. 5 shows the enlarged section of this item wherein the tag 130 is in place in the opening 230 in the sheet 201. It will be observed that an opening 232 has been provided to accommodate the tab 132 which will penetrate the opening 131 when it is placed around a ring as is shown in FIG. 7.

Figure 6:
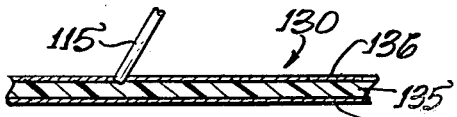
FIG. 6 is an enlarged sectionalized segment of the tag being marked in FIG. 5.

FIG. 6 is for the purpose of illustrating in greater detail a segment, in section, of the jewelry tag itself. A portion of the tag 130 is shown to comprise an intermediate material 135 which can be paper, plastic, or the like. A thin coating 136 is applied to at least one surface, and is generally applied to both surfaces of the tag material 135. This coating is usually a metallic paint or the like such that when it is scratched by the stylus point 115 it appears as a marking thereon. The tag itself is known to those skilled in the art and is the preferred type of jewelry tag.

It is to be recognized that, although not illustrated, a tag of ordinary cardboard or the like, could be utilized and a pen or the like, could be utilized for marking on the tag utilizing the method and apparatus of this invention. However, the invention is primarily directed to tags formed as illustrated in FIG. 6, since part of the difficulty is the appropriate pressure required to make proper markings by breaking through the coating 136.

Figure 8:
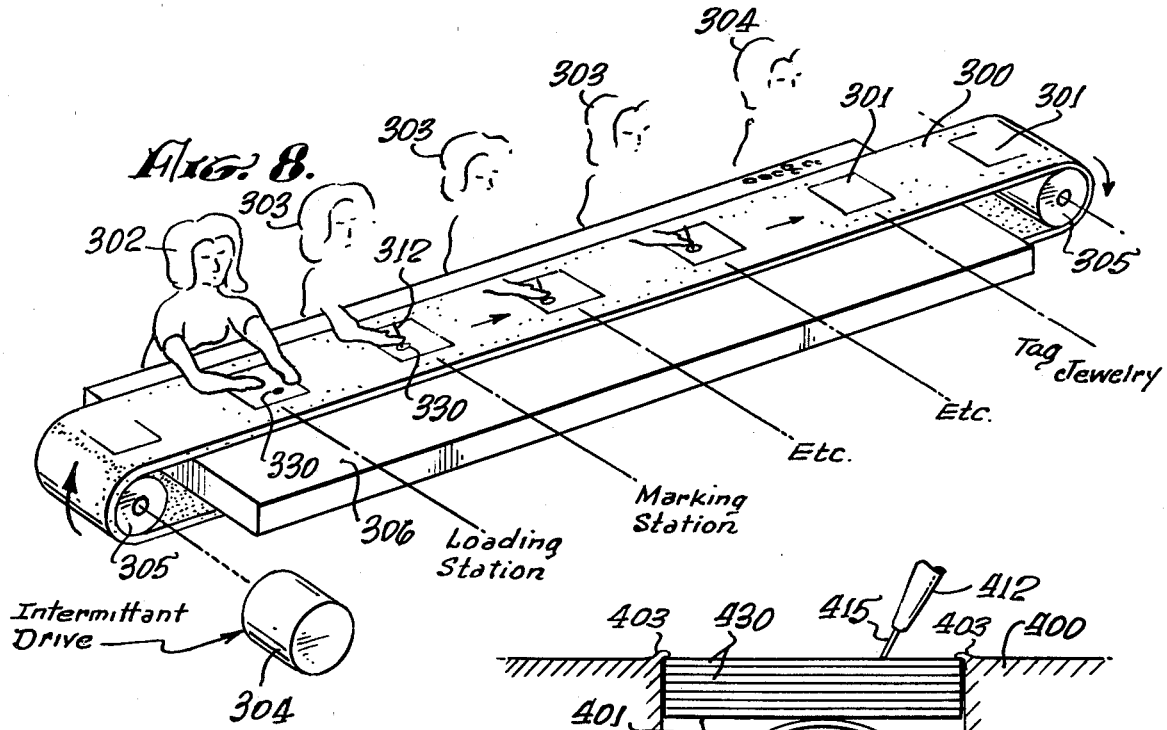
FIG. 8 is a schematic representation of an automated production line utilizing the method and apparatus of this invention.

FIG. 8 illustrates a method by which a production line could be utilized for even more rapid marking. In this case, a belt or the like 300 passes over two pulleys 305 and is driven by an intermittent drive 304. The belt is supported by an appropriate support surface 306, and will carry a number of different work stations 301 each of which will contain at least one tag opening of the nature shown in the previous figures.

The operator 302 may load the tags in the tag opening 330, the operators 303 can utilize a stylus or the like 312 for marking, and the operator 304 can remove the tags and affix to the appropriate jewelry.

Figure 9:
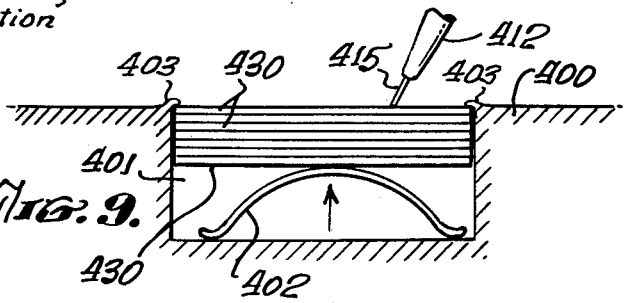
FIG. 9 is a partially sectioned schematic representation of another alternate utilization of the method of this invention.

FIG. 9 illustrates a material 400 having an opening 401 with a spring arrangement 402 located therein. A multiplicity of tags 430 can be loaded within the opening 401 and will be held by the small lip 403. With a multiplicity of the tags 430 being forced upward by the spring 402 against the lip 403, after marking by the stylus 412 and its tip 415, each tag can be removed and the next tag marked in order.

Figure 11:
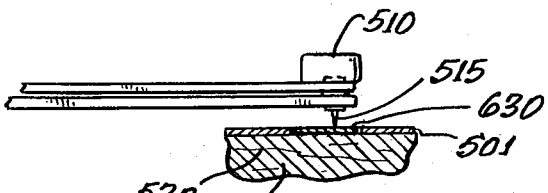
FIG. 11 is an enlarged, partially sectioned view of the area 11—11 of FIG. 10.
Figure 10:
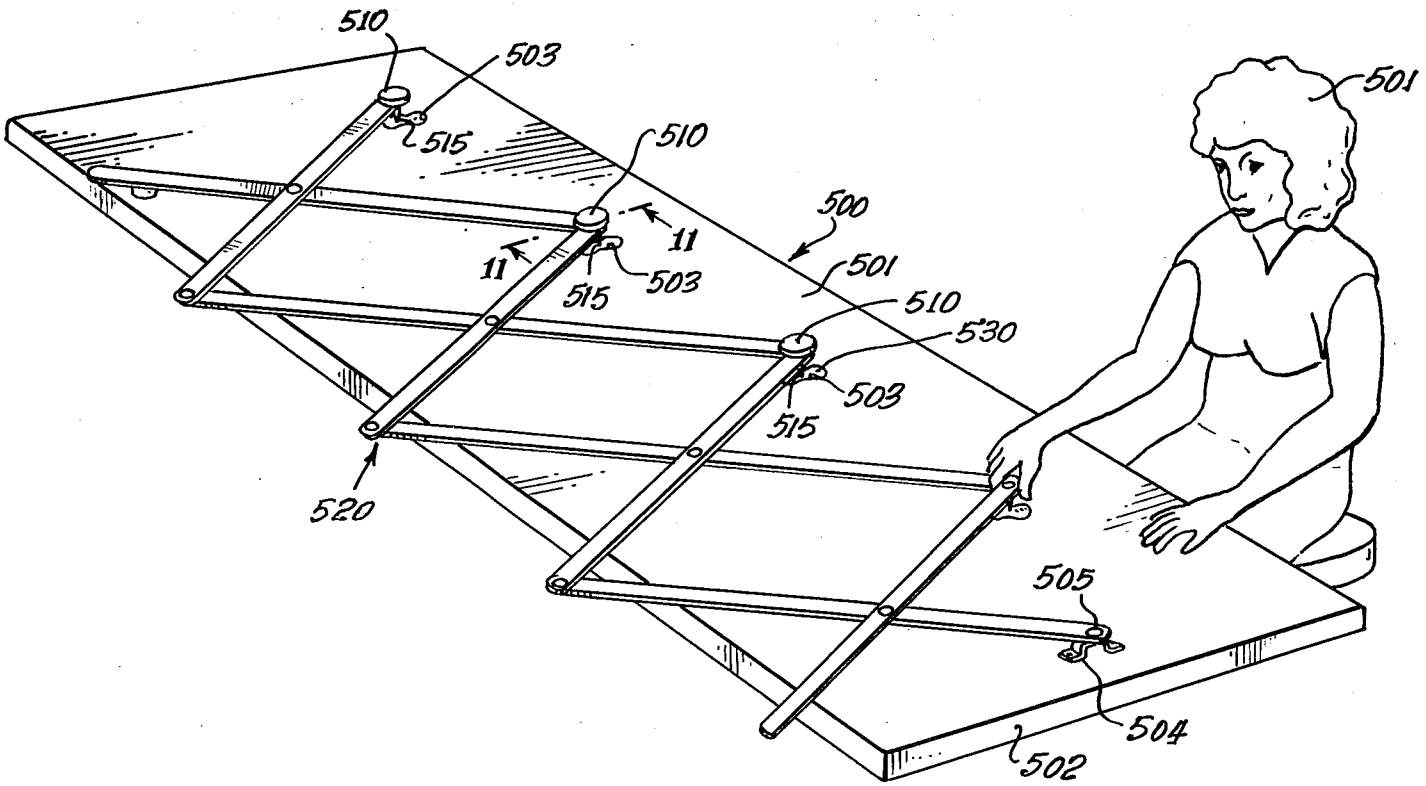
FIG. 10 is a perspective of an apparatus for practicing the method of this invention wherein a multiplicity of tags are marked by one person at one time.

A more important further extension of this invention is shown in FIGS. 10 and 11. In this case a work base 501 of any suitable material will be provided and a pantograph arrangement 502, as will be known to those skilled in the art, will be affixed at 504–505 in a customary manner to the base 500.

A multiplicity of stylus points 515 will be placed at each of the points indicated and a suitable weight or the like, 510 will be placed upon each. A number of openings 503 will be provided and tags 530 will be provided therein. Thus, when the operator 501 operates her one stylus position, each of the others will mark another tag. It will be observed that the construction of the work surface 500 is essentially the same as those previously shown wherein the stainless steel sheet or the like 501 has an opening 503 and is fastened to a base 502.

While the embodiments of this invention are fully capable of achieving the objects and advantages desired, it is to be understood that the embodiments shown are for purposes of illustration only and not for purposes of limitation.

I claim:

1. The method for marking jewelry tags comprising: providing a work base; providing openings within a sheet of stainless steel of approximately the same thickness as jewelry tags, each of which openings is suitable to accomodate a jewelry tag; affixing said sheet of stainless steel to said work base; placing a tag of the appropriate shape within each of said openings in said sheet of stainless steel; marking each of said tags with a marking device; and removing each of said tags from each of said openings.

2. The method as set forth in claim 1 wherein said scratching operation is accomplished with a scratching implement which cannot scratch upon said stainless steel sheet.

* * * * *